US010502449B2

(12) United States Patent
Kimura et al.

(10) Patent No.: US 10,502,449 B2
(45) Date of Patent: Dec. 10, 2019

(54) AIR CONDITIONER USING HEAT EXCHANGE WATER AND AIR CONDITIONING SYSTEM INCLUDING THE SAME

(71) Applicant: KIMURA KOHKI CO., LTD., Osaka-shi, Osaka (JP)

(72) Inventors: Keiichi Kimura, Yao (JP); Mitsuo Morita, Nabari (JP); Takayuki Ishida, Yao (JP); Kazuya Goto, Yao (JP); Hidekazu Sato, Osaka (JP)

(73) Assignee: KIMURA KOHKI CO., LTD., Osaka-Shi, Osaka (JP)

( * ) Notice: Subject to any disclaimer, the term of this patent is extended or adjusted under 35 U.S.C. 154(b) by 99 days.

(21) Appl. No.: 15/908,595

(22) Filed: Feb. 28, 2018

(65) Prior Publication Data

US 2018/0252431 A1 Sep. 6, 2018

(30) Foreign Application Priority Data

Mar. 1, 2017 (JP) ..... 2017-037888
Mar. 30, 2017 (JP) ..... 2017-066570

(51) Int. Cl.
*F24F 11/02* (2006.01)
*F24F 13/10* (2006.01)
(Continued)

(52) U.S. Cl.
CPC ..... *F24F 13/10* (2013.01); *F24F 1/00077* (2019.02); *F24F 3/14* (2013.01);
(Continued)

(58) Field of Classification Search
CPC ..... F24F 1/00077; F24F 2203/1056
See application file for complete search history.

(56) References Cited

U.S. PATENT DOCUMENTS 6,161,764 A * 12/2000 Jatnieks ..... F24F 3/044 236/49.3
6,467,537 B1 * 10/2002 Bujak, Jr. ..... F24F 3/06 165/209
(Continued)

FOREIGN PATENT DOCUMENTS

JP 01107041 A 4/1989
JP 11287475 A 10/1999
(Continued)

*Primary Examiner* — Jonathan Bradford
(74) *Attorney, Agent, or Firm* — Alleman Hall Creasman & Tuttle LLP

(57) ABSTRACT

An air conditioner includes: a first heat exchanger configured to perform a first process of cooling air-conditioning air by heat-exchange water; a second heat exchanger configured to perform a second process of cooling the air-conditioning air by the heat-exchange water; a first water passage configured to cause the heat-exchange water to flow through the first heat exchanger and then flow through the second heat exchanger; a second water passage branching off from the first water passage and configured to cause the heat-exchange water that has been used in the first process to flow in a manner to bypass the second heat exchanger; a first water regulating valve configured to adjust performance of the first heat exchanger in the first process; a second water regulating valve configured to adjust performance of the second heat exchanger in the second process; and an air conditioner control device configured to adjust the air-conditioning air.

7 Claims, 3 Drawing Sheets

(51) Int. Cl.

| | |
|---|---|
| ***F24F 5/00*** | (2006.01) |
| ***F24F 1/0007*** | (2019.01) |
| ***F24F 11/74*** | (2018.01) |
| ***F24F 3/14*** | (2006.01) |

(52) U.S. Cl.
CPC ..... *F24F 5/0003* (2013.01); *F24F 11/74* (2018.01); *F24F 2221/54* (2013.01)

(56) References Cited

U.S. PATENT DOCUMENTS

| | | | | |
|---|---|---|---|---|
| 2010/0307731 | A1 | 12/2010 | Yonezawa et al. | |
| 2013/0098597 | A1* | 4/2013 | Fujimoto ..... | H05K 7/20745 165/287 |
| 2016/0209085 | A1* | 7/2016 | Kim ..... | F25B 13/00 |

FOREIGN PATENT DOCUMENTS

| | | | |
|---|---|---|---|
| JP | 11304225 | A | 11/1999 |
| JP | 2000274785 | A | 10/2000 |
| JP | 2004156805 | A | 6/2004 |
| JP | 200569552 | A | 3/2005 |
| JP | 2005134010 | A | 5/2005 |
| JP | 2009162411 | A | 7/2009 |
| JP | 201025503 | A | 2/2010 |
| JP | 201071543 | A | 4/2010 |
| JP | 2011145045 | A | 7/2011 |
| JP | 2013100992 | A | 5/2013 |
| JP | 2013104639 | A | 5/2013 |
| JP | 2016085013 | A | 5/2016 |
| WO | 2012164684 | A1 | 12/2012 |

* cited by examiner

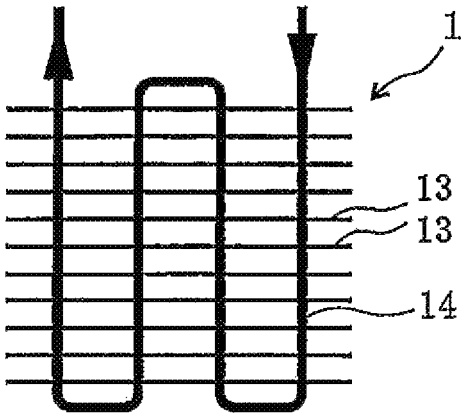
Fig. 2
120
| | |
|---|---|
| PRESET SUPPLY AIR TEMPERATURE | T1 |
| PRESET CARBON DIOXIDE CONCENTRATION RANGE | C1 |
| PRESET HUMIDITY OF SPACE TO BE AIR CONDITIONED | W1 |
| PRESET WATER TEMPERATURE DIFFERENCE | H1 |
Fig. 3
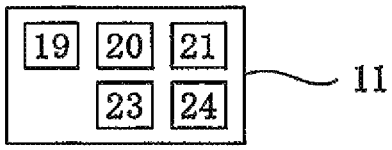
Fig. 4

AIR CONDITIONER USING HEAT EXCHANGE WATER AND AIR CONDITIONING SYSTEM INCLUDING THE SAME

BACKGROUND OF THE INVENTION

1. Field of the Invention

The present invention relates to an air conditioner and an air conditioning system including the same.

2. Description of the Related Art

In a case where the gross floor area of a building is a predetermined area or more, each room of the building is required to take in outside air, such that the carbon dioxide concentration in the room is reduced to a reference value or lower. Japanese Laid-Open Patent Application Publication No. 2009-162411 discloses an air conditioner that makes it possible to meet such requirement. The air conditioner is configured to: cause outside air and return air, both of which serve as air-conditioning air, to undergo heat exchange with two respective heat exchangers separately, and then mix them together; and supply the mixed air to a space to be air conditioned, thereby cooling or heating the space.

In the case of performing cooling by the air conditioner, low-temperature outside air that has been cooled and dehumidified is mixed with return air that has been subjected to sensible heat cooling, and thereby a temperature and humidity controlling effect is obtained, which is the same effect as that obtained in reheat control using cold water and hot water. Reheat control is also called "reheat system". Specifically, in the reheat control, return air from the interior of a room and outside air are mixed together; the mixed air is overcooled and dehumidified by condensation; and thereafter, the temperature of the air is increased by a reheater.

The above air conditioner includes: piping that causes heat-exchange water to flow through two heat exchangers in series; piping that causes the heat-exchange water to flow in a manner to bypass the heat exchangers; and four two-way valves provided on these piping. The flow rate of the heat-exchange water is adjusted by these four two-way valves, and thereby cooling or heating is performed. Thus, this air conditioner includes a large number of components including the two-way valves and the piping, and has problems of complex structure and high cost.

An object of the present invention is to provide an air conditioner that has a simplified structure and that makes cost reduction possible.

SUMMARY OF THE INVENTION

An air conditioner according to one aspect of the present invention includes: a first heat exchanger (1) configured to perform a first process of cooling or heating air-conditioning air by heat-exchange water that flows through the first heat exchanger (1), the air-conditioning air containing outside air from outside of a space (S) to be air conditioned and return air from the space (S) to be air conditioned; a second heat exchanger (2) configured to perform a second process of cooling or heating the air-conditioning air by the heat-exchange water that flows through the second heat exchanger (2); a first water passage (3) configured to cause the heat-exchange water to flow through the first heat exchanger (1) and then flow through the second heat exchanger (2); a second water passage (4) branching off from the first water passage (3) and configured to cause the heat-exchange water that has been used in the first process to flow in a manner to bypass the second heat exchanger (2); a first water regulating valve (5) configured to adjust a flow rate of the heat-exchange water to adjust performance of the first heat exchanger (1) in the first process; a second water regulating valve (6) configured to adjust a flow rate distribution of the heat-exchange water between the first water passage (3) and the second water passage (4) to adjust performance of the second heat exchanger (2) in the second process; and an air conditioner control device (11) configured to operate the first water regulating valve (5) and the second water regulating valve (6) to adjust the air-conditioning air to be in a suitable air condition for air conditioning of the space (S) to be air conditioned.

According to the configuration of the above aspect, since the second water passage branches off from the first water passage, the length of the piping forming these water passages is reduced. Also, by adopting this configuration, the number of water regulating valves can be reduced compared to the conventional art. That is, this configuration makes it possible to reduce the length of the piping forming the first water passage and the second water passage and minimize the number of components including the first water regulating valve and the second water regulating valve, thereby simplifying the structure. This realizes cost reduction.

In another aspect of the present invention, the air conditioner control device (11) includes an air conditioning performance controller (19) configured to switch a control to perform between a first control and a second control in accordance with variation in an air-conditioning load of the space (S) to be air conditioned, the first control being a control of operating the first water regulating valve (5) and the second water regulating valve (6) to vary the flow rate of the heat-exchange water while causing the heat-exchange water to flow through both the first heat exchanger (1) and the second heat exchanger (2), the second control being a control of operating the first water regulating valve (5) and the second water regulating valve (6) to vary the flow rate (water flow rate) of the heat-exchange water while causing the heat-exchange water to flow only through the first heat exchanger (1).

According to the above configuration, only by the two water regulating valves, the air-conditioning air can be precisely adjusted to be in suitable air conditions for the air conditioning in accordance with variation in the air-conditioning load of the space to be air conditioned. For example, when the air-conditioning load is at its peak, the flow rates of the heat-exchange water of both the heat exchangers are maximized by the two water regulating valves. When the air-conditioning load decreases, the flow rates of the heat-exchange water are reduced by the two water regulating valves in accordance with the amount of decrease in the air-conditioning load. When the air-conditioning load further decreases, the heat-exchange water is caused by the second water regulating valve to flow in a manner to bypass the second heat exchanger, and is caused by the first water regulating valve to flow only through the first heat exchanger. When the air-conditioning load is at a minimum, the heat-exchange water is caused by the second water regulating valve to flow in a manner to bypass the second heat exchanger, and the flow rate of the heat-exchange water flowing through the first heat exchanger is minimized by the first water regulating valve. In this manner, the air-conditioning air can be precisely adjusted to be in suitable air conditions for the air conditioning.

In yet another aspect of the present invention, the air conditioner includes: a first damper (8) configured to adjust an air volume of the air-conditioning air subjected to the first process; and a second damper (9) configured to adjust an air volume of the air-conditioning air subjected to the second process. The air conditioner control device (11) includes an air conditioning performance compensator (20) configured to: compare an enthalpy required for the first process with an enthalpy required for the second process; and operate the first damper (8) and the second damper (9) to decrease the air volume of the air-conditioning air subjected to the first or the second process that requires a greater enthalpy and increase the air volume of the air-conditioning air subjected to the first or the second process that requires a less enthalpy.

According to the above configuration, the air volume of the air-conditioning air subjected to the process that requires a greater enthalpy is decreased, and the air volume of the air-conditioning air subjected to the process that requires a less enthalpy is increased. Consequently, an unnecessary air-conditioning load is reduced, and thereby energy saving is realized.

In yet another aspect of the present invention, the air conditioner includes a humidifier (7) configured to humidify the air-conditioning air at a downwind side of one of or both the first heat exchanger (1) and the second heat exchanger (2). The air conditioner control device (11) includes an outside air cooling controller (23) configured to cool the space (S) to be air conditioned by performing humidification by the humidifier (7) in a case where a temperature of the outside air serving as the air-conditioning air is lower than a temperature of the space (S) to be air conditioned.

According to the above configuration, for example, in the case of performing cooling in a winter period, in which the temperature of the outside air serving as the air-conditioning air is low, the space to be air conditioned can be cooled by only performing humidification by the humidifier. This makes energy saving possible.

In yet another aspect of the present invention, the humidifier (7) is configured as a vaporizing humidifier that humidifies the air-conditioning air by evaporation of water, or configured as a steam humidifier that humidifies the air-conditioning air with steam.

According to the above configuration, if the humidifier is configured as a vaporizing humidifier, vaporization cooling can be utilized, which makes energy saving possible. If the humidifier is configured as a steam humidifier or as two vaporizing humidifiers, insufficient humidification will not occur even when performing outside air cooling, and thus a comfortable environment is realized.

In yet another aspect of the present invention, the first water regulating valve (5) is configured as a two-way valve, and the second water regulating valve (6) is configured as a three-way valve.

According to the above configuration, the two regulating valves can be configured as a two-way valve and a three-way valve, which are commercially available components. This makes cost reduction possible.

An air conditioning system according to yet another aspect of the present invention includes: the air conditioner (100) including the air conditioner control device (11); a heat source machine (600) configured to adjust a supply water temperature of circulating water that is supplied to the air conditioner (100) for air condition adjustment of the air-conditioning air; and a heat source machine control device (700) independent of the air conditioner control device (11), the heat source machine control device (700) being configured to automatically adjust the supply water temperature of the circulating water in accordance with variation in an outside air load.

According to the above configuration, since the air-conditioning load of the space to be air conditioned normally varies in proportion to the outdoor temperature and humidity, i.e., in proportion to the outside air load, it is expected that when the outside air load is small, the air-conditioning load of the space to be air conditioned is also small. Therefore, the supply water temperature of the circulating water supplied to the air conditioner may be raised in a summer period and lowered in a winter period by the heat source machine control device, and thereby the energy consumption of the heat source machine can be reduced, which makes energy saving possible. Since the control of the air conditioner side and the control of the heat source machine side are completely separated and are independent of each other without using a complex and costly central control system, the work of installation of both the control devices is simplified, and the maintenance of both the control devices can be readily performed.

In yet another aspect of the present invention, the air conditioning system includes a water circulating apparatus (800) configured to circulate the circulating water. The heat source machine control device (700) includes a heat source machine output compensator (770) configured to compensate for an excess output or a deficient output of the heat source machine (600) by controlling the water circulating apparatus (800) to adjust a water speed of the circulating water when a water temperature difference of the circulating water, the water temperature difference occurring due to supply of the circulating water to the air conditioner (100), deviates from a range of a preset water temperature difference.

According to the above configuration, when the water temperature difference of the circulating water, which occurs due to the heat exchange by the air conditioner, deviates from the range of the preset water temperature difference, it means that there is an excess or deficiency in the energy of the circulating water supplied to the air conditioner. Therefore, if the water temperature difference of the circulating water is greater than the range of the preset water temperature difference, the water circulating apparatus is controlled to increase the water speed of the circulating water, and if the water temperature difference of the circulating water is less than the range of the preset water temperature difference, the water circulating apparatus is controlled to decrease the water speed of the circulating water. In this manner, the excess or deficiency in the output of the heat source machine can be compensated for. Thus, even though the control of the air conditioner side and the control of the heat source machine side are completely separated and are independent of each other, the energy supply from the heat source machine to the air conditioner is stabilized, which makes it possible to maintain the comfortableness and realize energy saving.

In yet another aspect of the present invention, at a time of performing cooling of the space (S) to be air conditioned, the air conditioning system sets the supply water temperature of the circulating water, which is automatically adjusted by the heat source machine control device (700), such that: when a temperature and a humidity of the outside air are higher than a preset outside air temperature and a preset outside air humidity, the supply water temperature of the circulating water is set to 6 to 7° C.; when the temperature of the outside air is lower than the preset outside air temperature and the humidity of the outside air is higher than the preset outside air humidity, the supply water temperature of the circulating water is set to 7 to 8° C.; when the temperature of the outside air is higher than the preset outside air temperature and the humidity of the outside air is lower than the preset outside air humidity, the supply water temperature of the circulating water is set to 8 to 9° C.; and when the temperature and the humidity of the outside air are lower than the preset outside air temperature and the preset outside air humidity, the supply water temperature of the circulating water is set to 9 to 10° C., and at a time of performing heating of the space (S) to be air conditioned, the air conditioning system sets the supply water temperature of the circulating water, which is automatically adjusted by the heat source machine control device (700), such that: when the temperature of the outside air is higher than the preset outside air temperature, the supply water temperature of the circulating water is set to 34 to 36° C.; and when the temperature of the outside air is lower than the preset outside air temperature, the supply water temperature of the circulating water is set to 39 to 41° C.

According to the above configuration, fine adjustment of the supply water temperature of the circulating water is performed, and thereby energy saving efficiency of the entire air-conditioning system including the heat source machine and the air conditioner is improved.

BRIEF DESCRIPTION OF THE DRAWINGS

FIG. 2 shows a general configuration of a heat exchanger.

FIG. 3 shows a table stored in a memory.

FIG. 4 shows a variation of an air conditioner control device.

DESCRIPTION OF THE PREFERRED EMBODIMENTS

Embodiment 1

Figure 1:
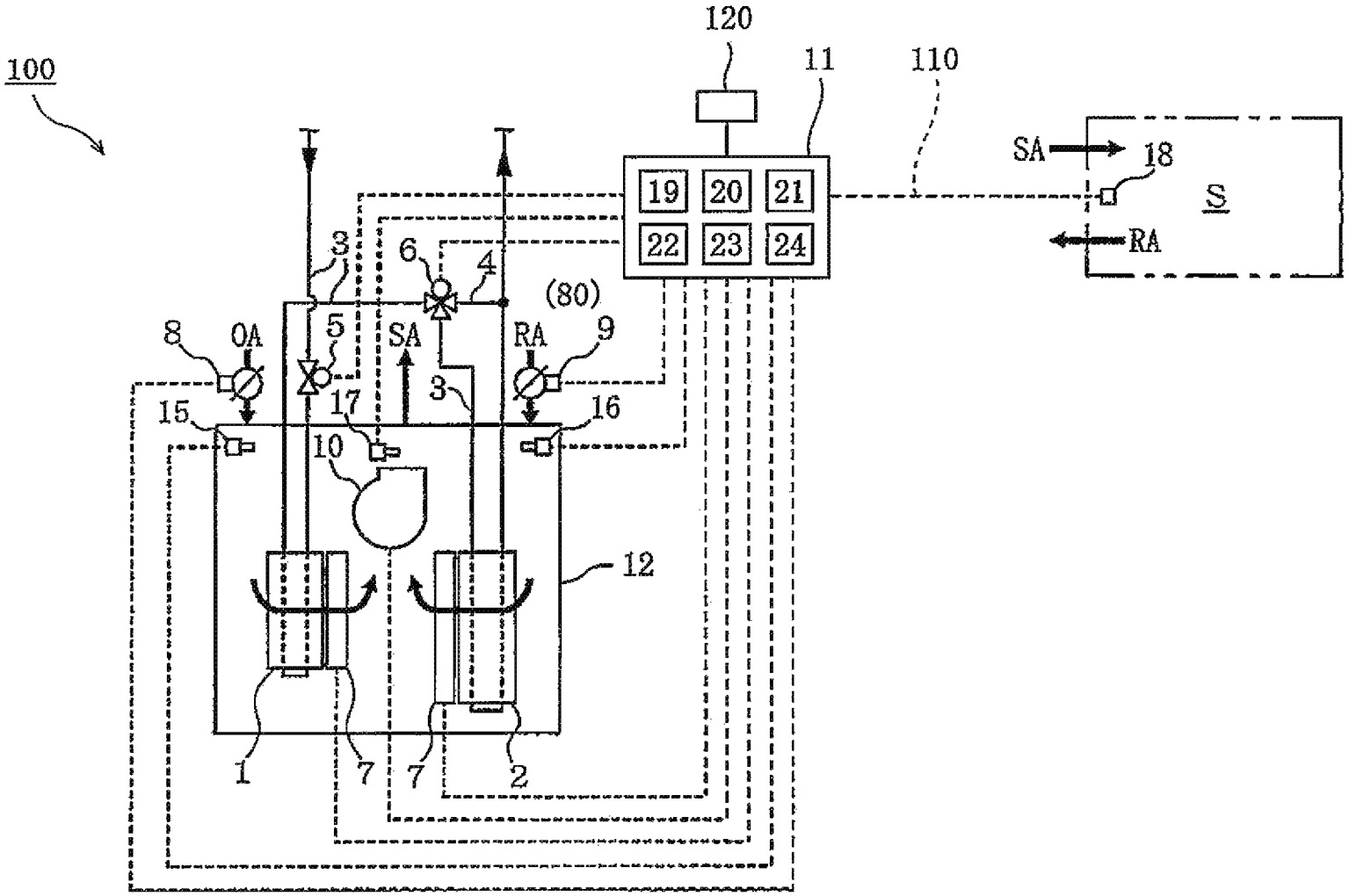
FIG. 1 shows an overall configuration of an air conditioner according to Embodiment 1 of the present invention.

FIG. 1 shows an overall configuration of an air conditioner 100 of a cold and hot water type according to the present invention. The air conditioner 100 is installed outside a space S to be air conditioned, which is, for example, a room or a hall in a building. That is, the air conditioner 100 is installed outdoors, and is connected to the space S to be air conditioned by a duct 110. The air conditioner 100 supplies outside air (OA) serving as air-conditioning air from outdoors to the space S to be air conditioned as supply air (SA), and receives return air (RA) serving as air-conditioning air from the space S to be air conditioned. In the drawings, each solid bold arrow indicates the direction of an air flow.

The air conditioner 100 includes: a first heat exchanger 1; a second heat exchanger 2; a first water passage 3; a second water passage 4; a first water regulating valve 5; a second water regulating valve 6; two humidifiers 7; a first damper 8 configured to adjust an air volume; a second damper 9 also configured to adjust an air volume; an air blower 10; an air conditioner control device 11; and a casing 12. The humidifiers 7 are provided on the heat exchangers 1 and 2, respectively. The first heat exchanger 1, the second heat exchanger 2, and the humidifiers 7 are provided in the casing 12. The first water passage 3 extends from each of the heat exchangers 1 and 2 to the outside of the casing 12. The first water regulating valve 5 is provided on the first water passage 3 extending from the first heat exchanger 1, and the second water regulating valve 6 is provided at a branch point where the first water passage 3 and the second water passage 4 branch off.

The first heat exchanger 1 performs a first process of cooling or heating the outside air (OA) serving as air-conditioning air by heat-exchange water that flows through the first heat exchanger 1. The second heat exchanger 2 performs a second process of cooling or heating the return air (RA) serving as air-conditioning air by the heat-exchange water that flows through the second heat exchanger 2. After the outside air (OA) and the return air (RA) both serving as air-conditioning air undergo heat exchange with the respective two heat exchangers 1 and 2 separately, the heat-exchanged outside air (OA) and return air (RA) are mixed together. The first water passage 3 causes the heat-exchange water to flow through the first heat exchanger 1 and then flow through the second heat exchanger 2 consecutively. The second water passage 4 causes the heat-exchange water that has been used in the first process to flow in a manner to bypass the second heat exchanger 2.

The first water regulating valve 5 is configured as a proportional control two-way valve that varies the flow rate of the heat-exchange water before the first process to adjust the performance of the first heat exchanger 1 in the first process. The second water regulating valve 6 is configured as a proportional control three-way valve that varies the flow rate distribution of the heat-exchange water between the first water passage 3 and the second water passage 4 to adjust the performance of the second heat exchanger 2 in the second process. The second water regulating valve 6 may be configured as a three-way valve whose only function is to switch the flow of the heat-exchange water such that the entire amount of heat-exchange water flows through one of the first water passage 3 and the second water passage 4, and no heat-exchange water flows though the other one of the water passages.

The air conditioner control device 11 operates the first water regulating valve 5, the second water regulating valve 6, the humidifiers 7, the first damper 8, the second damper 9, and the air blower 10 in accordance with variation in the air-conditioning load of the space S to be air conditioned, thereby adjusting the outside air, the return air, and the other air-conditioning air to be in suitable air conditions (temperature and humidity) for the air conditioning of the space S to be air conditioned. In FIG. 1, the first heat exchanger 1, the second heat exchanger 2, the humidifiers 7, and the air blower 10 are provided in the casing 12. Additionally, the air conditioner control device 11, the first water passage 3, the second water passage 4, the first water regulating valve 5, the second water regulating valve 6, the first damper 8, and the second damper 9 may also be provided in the casing 12.

The humidifiers 7 are configured as vaporizing humidifiers that humidify the air-conditioning air by evaporation of water at the downwind side of one of or both (in the illustrated example, both) the first heat exchanger 1 and the second heat exchanger 2. The first damper 8 increases/decreases, i.e., adjusts, the air volume of the air-conditioning air subjected to the first process. The second damper 9 increases/decreases, i.e., adjusts, the air volume of the air-conditioning air subjected to the second process. In the present embodiment, the outside air (OA) serving as air-conditioning air flows through the first damper 8, the first heat exchanger 1, and the corresponding humidifier 7, and the return air (RA) serving as air-conditioning air flows through the second damper 9, the second heat exchanger 2, and the corresponding humidifier 7. Then, the outside air (OA) and the return air (RA) are supplied to the space S to be air conditioned by the air blower 10. The first damper 8, the second damper 9, and the air blower 10 form an air volume adjusting device 80.

As shown in FIG. 2, similar to a general plate fin coil, the first heat exchanger 1 is formed by attaching a heat transfer pipe 14 to a plurality of heat transfer plates 13, which are arranged parallel to each other, by insertion, such that the heat transfer pipe 14 meanders through the plurality of heat transfer plates 13 in a crossing manner. The heat-exchange water, which is either cold water or hot water, is flowed through the heat transfer pipe 14, and the air-conditioning air is brought into contact with the heat transfer pipe 14 and the heat transfer plates 13. Accordingly, the air-conditioning air and the heat-exchange water exchange heat with each other, and thereby the air-conditioning air is cooled or heated. The second heat exchanger 2 is configured in the same manner as the first heat exchanger 1.

An outside air sensor 15 configured to detect the temperature and humidity of the outside air, a return air sensor 16 configured to detect the temperature and humidity of the return air, and a supply air sensor 17 configured to detect the temperature and humidity of the supply air are provided in the casing 12. A carbon dioxide concentration sensor 18 configured to detect the carbon dioxide concentration in the space S to be air conditioned is provided in the space S to be air conditioned. The air conditioner control device 11 includes an air conditioning performance controller 19, an air conditioning performance compensator 20, a carbon dioxide concentration controller 21, a vaporization cooling controller 22, an outside air cooling controller 23, and a water temperature difference controller 24. The air conditioner control device 11 is formed by a microprocessor, various sensors, and other control devices.

A memory 120 is connected to the air conditioner control device 11. As shown in FIG. 3, the memory 120 stores a preset supply air temperature T1, a preset carbon dioxide concentration range C1, a preset humidity W1 of the space S to be air conditioned, a preset water temperature difference H1, and so forth. These values may be set by a user or installation provider of the air conditioner 100.

The air conditioning performance controller 19 switches a control to perform between a first control and a second control in accordance with variation in the air-conditioning load of the space S to be air conditioned. The first control is a control of operating the first water regulating valve 5 and the second water regulating valve 6 to vary the flow rate of the heat-exchange water while causing the heat-exchange water to flow through both the first heat exchanger 1 and the second heat exchanger 2. The second control is a control of operating the first water regulating valve 5 and the second water regulating valve 6 to vary the flow rate of the heat-exchange water while causing the heat-exchange water to flow only though the first heat exchanger 1. For example, in a case where only performing the first process by the first heat exchanger 1 is not enough to obtain sufficient cooling or heating performance for cooling or heating the space S to be air conditioned, the second process can also be performed by the second heat exchanger 2 to compensate for the deficiency in performance. The air conditioning performance controller 19 is capable of operating the humidifiers 7.

The air conditioning performance compensator 20 calculates enthalpies based on the temperature and humidity detected by the outside air sensor 15 and the temperature and humidity detected by the return air sensor 16. The air conditioning performance compensator 20 compares an enthalpy required for the first process performed by the first heat exchanger 1 with an enthalpy required for the second process performed by the second heat exchanger 2. The air conditioning performance compensator 20 operates the first damper 8 and the second damper 9 to decrease the air volume of the air-conditioning air subjected to the first or the second process that requires a greater enthalpy and increase the air volume of the air-conditioning air subjected to the first or the second process that requires a less enthalpy. Since the air volume of the air-conditioning air subjected to the process that requires a greater enthalpy is decreased, and the air volume of the air-conditioning air subjected to the process that requires a less enthalpy is increased in this manner, an unnecessary air-conditioning load is reduced, and thereby energy saving is realized. The enthalpy required for the first process means an enthalpy required for cooling or heating the air-conditioning air that has not undergone the first process to the preset supply air temperature T1. The enthalpy required for the second process means an enthalpy required for cooling or heating the air-conditioning air that has not undergone the second process to the preset supply air temperature T1.

For example, in a case where the enthalpy required for the first process is less than the enthalpy required for the second process, the air volume of the outside air before the first process is increased, and the air volume of the return air before the second process is decreased. In this manner, wasteful use of cooling or heating energy is reduced. The enthalpy required for the first process and the enthalpy required for the second process are calculated based on the temperature and humidity detected by the outside air sensor 15 and the temperature and humidity detected by the return air sensor 16.

The carbon dioxide concentration controller 21 operates one of or both the first damper 8 and the second damper 9 to adjust the air volume of the outside air serving as air-conditioning air, such that the carbon dioxide concentration in the space S to be air conditioned, which is detected by the carbon dioxide concentration sensor 18, is in the preset range C1. In the present embodiment, the first damper 8 adjusts the air volume of the outside air, and the second damper 9 adjusts the air volume of the return air.

In a case where one of or both the humidity of the air-conditioning air before the first process by the first heat exchanger 1 and the humidity of the air-conditioning air before the second process by the second heat exchanger 2 is/are lower than the preset humidity W1 of the space S to be air conditioned, the vaporization cooling controller 22 operates the humidifier(s) 7 to perform vaporization cooling in one of or both the first process and the second process. For example, during a cooling operation, if one of or both the humidity of the outside air before the first process and the humidity of the return air before the second process is/are lower than the preset humidity W1 of the space S to be air conditioned, one of or both the outside air and the return air is/are humidified and cooled by evaporation without increasing the flow rate (the cooling energy) of the heat-exchange water flowing through one of or both the first heat exchanger 1 and the second heat exchanger 2. This realizes energy saving. The humidity of the space S to be air conditioned is detected by the return air sensor 16, and the humidity of the outside air is detected by the outside air sensor 15.

The outside air cooling controller 23 cools the space S to be air conditioned by performing humidification by the humidifiers 7 in a case where the temperature of the outside air serving as air-conditioning air is lower than the temperature of the space S to be air conditioned. For example, if the temperature of the outside air before the first process by the first heat exchanger 1 is lower than the temperature of the space S to be air conditioned, the space S to be air conditioned can be cooled by the outside air while utilizing vaporization cooling.

In the case of causing the heat-exchange water to flow through the first heat exchanger 1 and then flow through the second heat exchanger 2 consecutively, the water temperature difference controller 24 operates the first water regulating valve 5 and the second water regulating valve 6 to control the flow rate of the heat-exchange water, such that the difference between the temperature of the heat-exchange water before flowing through the first heat exchanger 1 and the second heat exchanger 2 and the temperature of the heat-exchange water after flowing through the first heat exchanger 1 and the second heat exchanger 2 is the preset water temperature difference H1. By causing the heat-exchange water to flow through the first heat exchanger 1 and the second heat exchanger 2 consecutively, the water temperature difference is increased and variation in the water temperature difference is suppressed. This makes it possible to improve the operating efficiency of a heat source machine and realize energy saving.

In FIG. 1, the first heat exchanger 1, the second heat exchanger 2, the humidifiers 7, and the air blower 10 are provided in the casing 12. However, additionally, the air conditioner control device 11, the first water passage 3, the second water passage 4, the first water regulating valve 5, the second water regulating valve 6, the first damper 8, and the second damper 9 may also be provided in the casing 12.

(Control Operations)

(In the Case of Performing Cooling Operation Requiring Dehumidification in Summer Period)

In a case where the heat-exchange water is cold water and a cooling operation requiring dehumidification is performed in a summer period, the air conditioning performance controller 19 cools the outside air by the first heat exchanger 1. As a result of cooling the outside air, the outside air is dehumidified to some degree. The air conditioning performance controller 19 generates, by the second heat exchanger 2, the return air that has been cooled to such a degree that the return air is not dehumidified. The return air and the dehumidified outside air are mixed together, and thereby the temperature and humidity of the supply air are controlled to be a target supply air temperature and a target supply air humidity. In this manner, the space S to be air conditioned is air conditioned to the preset temperature T1 and the preset humidity W1. When a cooling operation that does not require dehumidification of the outside air is performed, the outside air cooling controller 23 may be operated, and thereby vaporization cooling by the humidifiers 7 may also be utilized in the cooling operation.

(In the Case of Performing Heating Operation in Winter Period)

In a case where the heat-exchange water is hot water and a heating operation is performed in a winter period, the air conditioning performance controller 19 heats the outside air by the first heat exchanger 1, heats the return air by the second heat exchanger 2, dehumidifies the outside air and the return air by the humidifiers as necessary, and mixes the outside air and the return air together, thereby controlling the temperature and humidity of the supply air.

(In the Case of Performing Cooling Operation in Winter Period)

In a case where the temperature of the space S to be air conditioned is high even in a winter period, a cooling operation is performed. In this case, if the heat-exchange water is hot water, the air conditioning performance controller 19 directly supplies the outside air, the temperature of which is lower than the temperature of the space S to be air conditioned, as supply air (SA) without heating it by the first heat exchanger 1, and directly supplies the return air (RA) to the space S to be air conditioned without heating it by the second heat exchanger 2, thereby performing cooling with the outside air. In this case, the outside air may be heated by the first heat exchanger 1 to a suitable temperature for the cooling. The return air (RA) is humidified by the humidifier 7 as necessary. Here, by humidifying the return air having a high temperature, the amount of humidity can be increased even with the vaporizing humidifier.

It should be noted that, in the air conditioner 100 shown in FIG. 1, the humidifiers 7 may be configured as steam humidifiers that humidify the air-conditioning air with steam at the downwind side of one of or both the first heat exchanger 1 and the second heat exchanger 2. In this case, as shown in FIG. 4, the vaporization cooling controller 22 can be eliminated from the air conditioner control device 11. In this case, heating by steam humidification can be performed in an intermediate period between summer and winter.

Embodiment 2

The applicant of the present application has conceived of an air conditioning system using the air conditioner 100 shown in FIG. 1. A general air conditioning system includes: a heat source machine configured to adjust the temperature of circulating water; an air conditioner as described above, which is configured to adjust the supply air temperature of the air-conditioning air by heat exchangers through which the circulating water flows, thereby performing air conditioning of a space to be air conditioned; and a water circulating apparatus configured to circulate the circulating water through the air conditioner and the heat source machine. The circulating water whose temperature has deviated from its setting water temperature as a result of absorbing heat from or releasing heat to the air-conditioning air in the heat exchangers of the air conditioner is cooled or heated by the heat source machine, and thereby the temperature of the circulating water is adjusted to the setting water temperature. Such a general air conditioning system performs central control, in which the supply water temperature of the heat source machine is varied in accordance with the air-conditioning load of the space to be air conditioned, and thereby power saving of the heat source machine is realized.

However, such central control requires sensors for measuring the air-conditioning load of the space to be air conditioned and communication devices communicating with a heat source machine control device and an air conditioner control device, and the control is complex. Moreover, the equipment cost, such as the installation cost of these sensors and communication devices, is high. Furthermore, the air conditioner performs, for example, cooling, dehumidification, and heating by the heat exchangers after the outside air and the return air are mixed together. Such an air conditioner is, in the case of performing, for example, a cooling operation in a summer period, unable to perform humidity control of the supply air unless reheating is performed after cooling dehumidification is performed. Therefore, energy for the reheating is necessary, and in addition, so-called four-pipe equipment in which cold water and hot water are flowed concurrently is necessary. This results in high equipment cost and operating cost of the air conditioner. There are cases where a cooling operation becomes necessary even in a winter period. Such a case also requires four-pipe equipment. Thus, there are problems of high equipment cost and high operating cost. The applicant has conceived of an air conditioning system described below to solve these problems.

Figure 5:
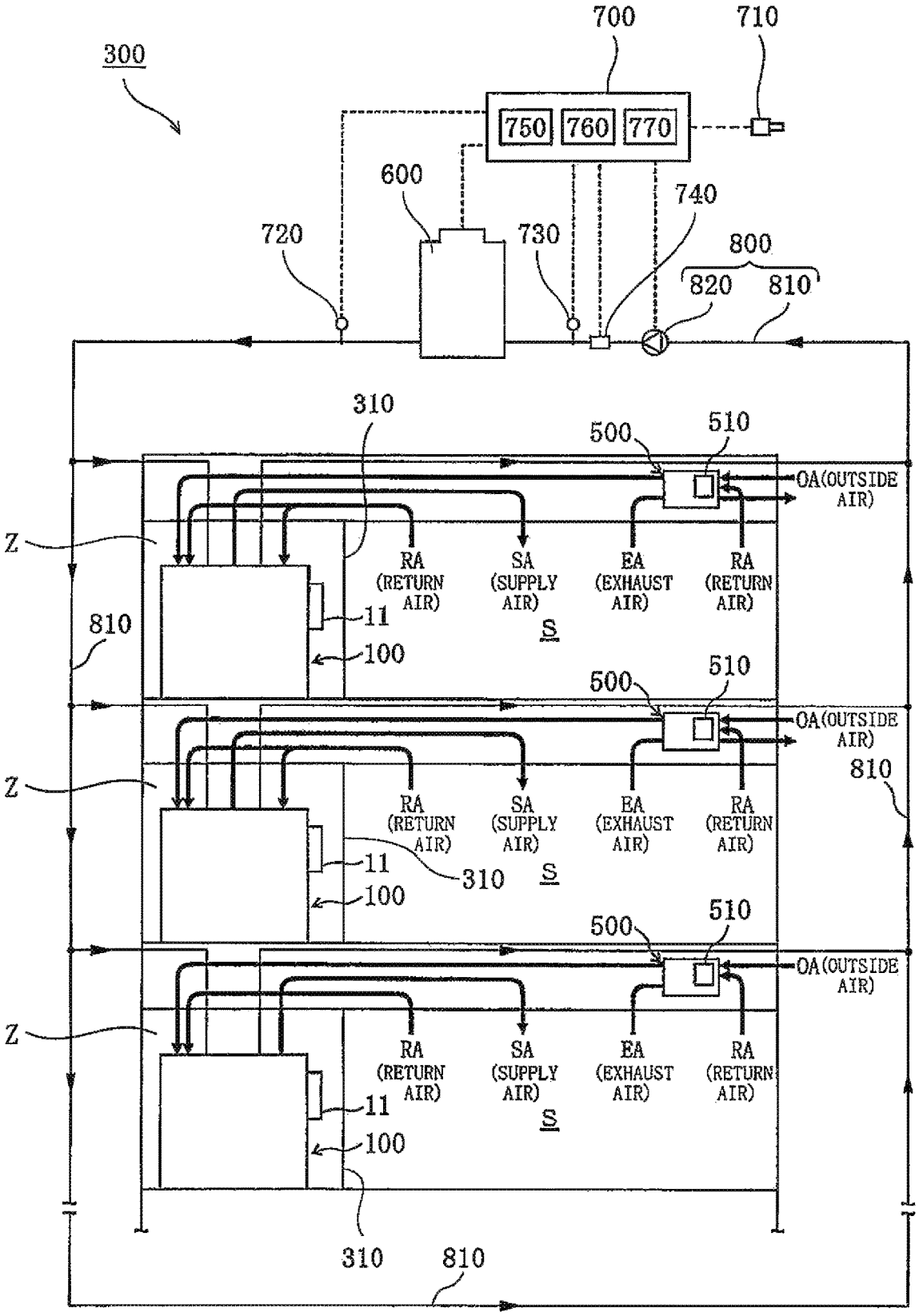
FIG. 5 shows an air conditioning system in which air conditioners as shown in FIG. 1 are used.

FIG. 5 shows the entirety of an air conditioning system 300. The air conditioning system 300 includes: air conditioners 100 as described above, each including the air conditioner control device 11; outside conditioners 500 each including an outside conditioner control device 510; a heat source machine 600; a water circulating apparatus 800; and a heat source machine control device 700. The air conditioning system 300 is used in, for example, a three-story building 400. On each floor of the building 400, there is a space S to be air conditioned, such as a room or a hall, and an installation space Z for the air conditioner 100. That is, in the present embodiment, the air conditioning system 300 includes three air conditioners 100. It should be noted that the building 400 is not limited to a three-story building.

Each space S to be air conditioned, the outside of the building 400, a corresponding one of the air conditioners 100, and a corresponding one of the outside conditioners 500 are connected by ducts that are not shown, and feed supply air (SA), outside air (OA), return air (RA), and exhaust air (EA) to each other. The space S to be air conditioned and the installation space Z are partitioned off from each other by a partition wall 310. Each installation space Z is provided with one air conditioner 100, and the internal configuration of the air conditioner 100 is as shown in FIG. 1.

The heat source machine 600 is provided at the top of the building 400, and adjusts the supply water temperature of circulating water that is supplied to the air conditioners 100 for air condition adjustment of the air-conditioning air. The water circulating apparatus 800 includes: water circulating piping 810 configured to circulate the circulating water through the heat source machine 600 and the air conditioners 100; and a water supply pump 820 capable of varying the water speed and the water supply amount of the circulating water flowing through the water circulating piping 810. The heat source machine control device 700 is a control device independent of the air conditioner control device 11, and is configured to automatically adjust the supply water temperature of the circulating water in accordance with variation in the outside air load.

The heat source machine control device 700 is connected to: an outside air temperature and humidity detector 710 configured to detect the temperature and humidity of the outside air; a supply water temperature detector 720 configured to detect the supply water temperature of the circulating water supplied to the air conditioners 100; a return water temperature detector 730 configured to detect the return water temperature of the circulating water returning to the heat source machine 600 from the air conditioners 100; and a water supply detector 740 configured to detect the water speed and the water supply amount in the water circulating piping 810. The heat source machine control device 700 includes a water supply controller 750, a supply water temperature controller 760, and a heat source machine output compensator 770. The heat source machine control device 700 is formed by a microprocessor, various sensors, and other control devices.

The water supply controller 750 adjusts the water speed and the water supply amount by controlling the rotational speed of the water supply pump 820. The supply water temperature controller 760 compares the outside air temperature and outside air humidity detected by the outside air temperature and humidity detector 710 with a preset outside air temperature and a preset outside air humidity. In accordance with the comparison results, at the time of performing the cooling of the space S to be air conditioned, the supply water temperature controller 760 sets the supply water temperature of the circulating water, which is automatically adjusted by the heat source machine control device 700, such that: when the outside air temperature and outside air humidity are higher than the preset outside air temperature and preset outside air humidity, the supply water temperature of the circulating water is set to 6 to 7° C.; when the outside air temperature is lower than the preset outside air temperature and the outside air humidity is higher than the preset outside air humidity, the supply water temperature of the circulating water is set to 7 to 8° C.; when the outside air temperature is higher than the preset outside air temperature and the outside air humidity is lower than the preset outside air humidity, the supply water temperature of the circulating water is set to 8 to 9° C.; and when the outside air temperature and outside air humidity are lower than the preset outside air temperature and preset outside air humidity, the supply water temperature of the circulating water is set to 9 to 10° C. The preset outside air temperature and preset outside air humidity in this case are, for example, a dry-bulb temperature of 28° C. and an absolute humidity of 0.011 kg/kg (DA).

At the time of performing the heating of the space S to be air conditioned, the supply water temperature controller 760 sets the supply water temperature of the circulating water, which is automatically adjusted by the heat source machine control device 700, such that: when the outside air temperature is higher than the preset outside air temperature, the supply water temperature of the circulating water is set to 34 to 36° C.; and when the outside air temperature is lower than the preset outside air temperature, the supply water temperature of the circulating water is set to 39 to 41° C. The preset outside air temperature in this case is, for example, a dry-bulb temperature of 13° C. It should be noted that the aforementioned supply water temperatures, preset outside air temperatures, and preset outside air humidity are merely examples, and are not limited to these example values.

When a water temperature difference of the circulating water, the water temperature difference occurring due to the supply of the circulating water to the air conditioners 100 (i.e., the difference between the temperature of the circulating water supplied from the heat source machine 600 to the air conditioners 100 and the temperature of the circulating water returning to the heat source machine 600 from the air conditioners 100), deviates from the range of the preset water temperature difference (e.g., 6 to 10° C.), the heat source machine output compensator 770 compensates for an excess output or a deficient output of the heat source machine 600 by controlling the water circulating apparatus 800 to adjust the water speed of the circulating water. The water temperature difference of the circulating water is calculated based on the water temperature detected by the supply water temperature detector 720 and the water temperature detected by the return water temperature detector 730. The heat source machine output compensator 770 compares the water temperature difference of the circulating water with the range of the preset water temperature difference. If the water temperature difference of the circulating water is greater than the range of the preset water temperature difference, the heat source machine output compensator 770 controls the water circulating apparatus 800 to increase the water speed and the water supply amount of the circulating water. If the water temperature difference of the circulating water is less than the range of the preset water temperature difference, the heat source machine output compensator 770 controls the water circulating apparatus 800 to decrease the water speed and the water supply amount of the circulating water.

It should be noted that various machines such as a heat pump chiller and a suction chiller are applicable as the heat source machine 600. The piping system of the water circulating piping 810 may be freely modified into any of various types of piping systems, such as a direct return system, a reverse return system, or a combination of these.

The first water regulating valve 5 and the second water regulating valve 6 are not limited to the two-way and three-way valves, but may be different types of valves. In the above description, the outside air serving as air-conditioning air and the return air serving as air-conditioning air can be replaced with each other. Each humidifier 7 may be configured to include one of or both a vaporizing humidifier and a steam humidifier. For example, the air-conditioning air may be first humidified by the vaporizing humidifier that consumes less energy, and if the humidification by the vaporizing humidifier alone is insufficient, the steam humidifier may be used at least for compensating for the insufficiency in the humidification. This makes it possible to realize both improvement in humidification precision and reduction of energy consumption.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

LIST OF REFERENCE CHARACTERS

1 first heat exchanger
2 second heat exchanger
3 first water passage
4 second water passage
5 first water regulating valve
6 second water regulating valve
7 humidifier
8 first damper
9 second damper
11 air conditioner control device
19 air conditioning performance controller
22 vaporization cooling controller
23 outside air cooling controller
300 air conditioning system
600 heat source machine
700 heat source machine control device

The invention claimed is:

1. An air conditioning system comprising:

an air conditioner which includes:

a first heat exchanger configured to perform a first process of cooling or heating air-conditioning air by heat-exchange water that flows through the first heat exchanger, the air-conditioning air containing outside air from outside of a space to be air conditioned and return air from the space to be air conditioned;

a second heat exchanger configured to perform a second process of cooling or heating the air-conditioning air by the heat-exchange water that flows through the second heat exchanger;

a first water passage configured to cause the heat-exchange water to flow through the first heat exchanger and then flow through the second heat exchanger;

a second water passage branching off from the first water passage and configured to cause the heat-exchange water that has been used in the first process to flow in a manner to bypass the second heat exchanger;

a first water regulating valve configured to adjust a flow rate of the heat-exchange water to adjust performance of the first heat exchanger in the first process;

a second water regulating valve configured to adjust a flow rate distribution of the heat-exchange water between the first water passage and the second water passage to adjust performance of the second heat exchanger in the second process; and an air conditioner control device including a first processor configured to operate the first water regulating valve and the second water regulating valve to adjust the air-conditioning air to be in a suitable air condition for air conditioning of the space to be air conditioned;

a chiller configured to adjust a supply water temperature of circulating water that is supplied to the air conditioner for air condition adjustment of the air-conditioning air; and a chiller control device independent of the air conditioner control device, the chiller control device including a second processor configured to automatically adjust the supply water temperature of the circulating water in accordance with variation in an outside air load, wherein at a time of performing cooling of the space to be air conditioned, the air conditioning system sets the supply water temperature of the circulating water, which is automatically adjusted by the chiller control device, such that: when a temperature and a humidity of the outside air are higher than a preset outside air temperature and a preset outside air humidity, the supply water temperature of the circulating water is set to 6 to 7° C.; when the temperature of the outside air is lower than the preset outside air temperature and the humidity of the outside air is higher than the preset outside air humidity, the supply water temperature of the circulating water is set to 7 to 8° C.; when the temperature of the outside air is higher than the preset outside air temperature and the humidity of the outside air is lower than the preset outside air humidity, the supply water temperature of the circulating water is set to 8 to 9° C.; and when the temperature and the humidity of the outside air are lower than the preset outside air temperature and the preset outside air humidity, the supply water temperature of the circulating water is set to 9 to 10° C., and at a time of performing heating of the space to be air conditioned, the air conditioning system sets the supply water temperature of the circulating water, which is automatically adjusted by the chiller control device, such that: when the temperature of the outside air is higher than the preset outside air temperature, the supply water temperature of the circulating water is set to 34 to 36° C.; and when the temperature of the outside air is lower than the preset outside air temperature, the supply water temperature of the circulating water is set to 39 to 41° C.

2. The air conditioning system according to claim 1, wherein the air conditioner control device includes an air conditioning performance controller configured to switch a control to perform between a first control and a second control in accordance with variation in an air-conditioning load of the space to be air conditioned, the first control being a control of operating the first water regulating valve and the second water regulating valve to vary the flow rate of the heat-exchange water while causing the heat-exchange water to flow through both the first heat exchanger and the second heat exchanger, the second control being a control of operating the first water regulating valve and the second water regulating valve to vary the flow rate of the heat-exchange water while causing the heat-exchange water to flow only through the first heat exchanger.

3. The air conditioning system according to claim 1, comprising:

a first damper configured to adjust an air volume of the air-conditioning air subjected to the first process; and a second damper configured to adjust an air volume of the air-conditioning air subjected to the second process, wherein the air conditioner control device includes an air conditioning performance compensator configured to:

compare an enthalpy required for the first process with an enthalpy required for the second process; and operate the first damper and the second damper to decrease the air volume of the air-conditioning air subjected to the first or the second process that requires a greater enthalpy and increase the air volume of the air-conditioning air subjected to the first or the second process that requires a lesser enthalpy.

4. The air conditioning system according to claim 1, further comprising a humidifier configured to humidify the air-conditioning air at a downwind side of one of or both the first heat exchanger and the second heat exchanger, wherein the air conditioner control device includes an outside air cooling controller configured to cool the space to be air conditioned by performing humidification by the humidifier in a case where a temperature of the outside air serving as the air-conditioning air is lower than a temperature of the space to be air conditioned.

5. The air conditioning system according to claim 4, wherein the humidifier is configured as a vaporizing humidifier that humidifies the air-conditioning air by evaporation of water, or configured as a steam humidifier that humidifies the air-conditioning air with steam.

6. The air conditioning system according to claim 1, wherein the first water regulating valve is configured as a two-way valve, and the second water regulating valve is configured as a three-way valve.

7. The air conditioning system according to claim 1, comprising a water circulating apparatus including a water pump configured to circulate the circulating water, wherein the chiller control device includes a chiller output compensator configured to compensate for an excess output or a deficient output of the chiller by controlling the water circulating apparatus to adjust a water speed of the circulating water when a water temperature difference of the circulating water, the water temperature difference occurring due to supply of the circulating water to the air conditioner, deviates from a range of a preset water temperature difference.

* * * * *